US006901634B2

(12) United States Patent
Shaw et al.

(10) Patent No.: US 6,901,634 B2
(45) Date of Patent: Jun. 7, 2005

(54) DOOR CHECK DEVICE WITH INSERT MOLDED ROLLER

(75) Inventors: David W. Shaw, Richmond Hill (CA); Chuan Liang, Scarborough (CA)

(73) Assignee: Ventra Group Inc., Ontario (CA)

( * ) Notice: Subject to any disclaimer, the term of this patent is extended or adjusted under 35 U.S.C. 154(b) by 1 day.

(21) Appl. No.: 10/293,556

(22) Filed: Nov. 14, 2002

(65) Prior Publication Data

US 2004/0093691 A1 May 20, 2004

(51) Int. Cl.[7] ..... E05D 11/10
(52) U.S. Cl. ..... 16/344; 403/364
(58) Field of Search ..... 16/63, 65, 85, 16/331, 332, 334, 344, 345; 403/364

(56) References Cited

U.S. PATENT DOCUMENTS

| | | | | |
|---|---|---|---|---|
| 411,637 A | * | 9/1889 | Batchelor et al. | 140/111 |
| 2,110,889 A | * | 3/1938 | Mitchell | 16/65 |
| 3,710,417 A | | 1/1973 | Berman et al. | |
| 4,090,274 A | * | 5/1978 | Bourgeois | 16/317 |
| 4,419,788 A | | 12/1983 | Prout | |
| 4,532,675 A | | 8/1985 | Salazar | |
| 4,800,624 A | | 1/1989 | Whitefoot et al. | |
| 4,800,856 A | | 1/1989 | Baltz et al. | |
| 5,018,243 A | | 5/1991 | Anspaugh et al. | |
| 5,074,010 A | * | 12/1991 | Gignac et al. | 16/334 |
| 5,323,512 A | | 6/1994 | Little | |
| 5,445,483 A | * | 8/1995 | Fultz | 411/181 |
| 5,452,501 A | | 9/1995 | Kramer et al. | |
| 5,509,175 A | | 4/1996 | Baughan et al. | |
| 5,570,498 A | | 11/1996 | Hipkiss et al. | |
| 5,590,441 A | | 1/1997 | Spencer | |
| 6,038,738 A | | 3/2000 | Neag et al. | |
| 6,065,185 A | | 5/2000 | Breed et al. | |
| 6,349,448 B1 | | 2/2002 | Breed et al. | |
| 6,357,081 B1 | | 3/2002 | Bender | |

FOREIGN PATENT DOCUMENTS

| | | |
|---|---|---|
| GB | 2 160 256 | 12/1985 |

* cited by examiner

*Primary Examiner*—Gary S. Hartmann
(74) *Attorney, Agent, or Firm*—Pillsbury Winthrop Shaw Pittman, LLP

(57) ABSTRACT

A door check device, for installation between a motor vehicle body and a motor vehicle door that swings in opposing opening and closing directions relative to the vehicle body, with an improved roller is provided. The roller includes a metal core having an internal bore and a molded plastic bushing lining the internal bore such that the metal core and the plastic bushing include interlocked or bonded structures that essentially prevent the relative rotation between the metal core and the plastic bushing.

23 Claims, 7 Drawing Sheets

DOOR CHECK DEVICE WITH INSERT MOLDED ROLLER

BACKGROUND OF THE INVENTION

1. Field of the Invention

The present invention relates to a door check device for installation between a motor vehicle body and a motor vehicle door.

2. Description of Related Art

Door check devices are well-known in the art for use in checking the swinging motion of vehicle doors. There are many different types of door check devices, but all of them function to hold a vehicle door in a predetermined position, thereby preventing a door from closing on its own (or preventing it from opening further).

Most door check devices have a profiled link member that is engaged by one or two rollers. In this type of system, a link member is mounted on either the vehicle door or the vehicle itself. The roller is mounted on a roller mounting pin that is mounted on the opposite part, such that if the link member is mounted to the vehicle, the roller is mounted to the door and vice-versa. The profile of the link member has one or more detents in which the roller(s) is/are received under spring biasing. This engagement checks the door in its predetermined position. Some of these rollers are made out of metal. This causes problems because the metal roller rubs against other metal parts within the door check device, particularly the shaft or pin on which it is normally mounted, thereby creating squeaks and noises. Although lubrication can temporarily quiet the squeaks and noises, the lubrication has to be applied often to work effectively. This creates a maintenance task that is undesirable. Also, the presence of excess grease can be problematic during the painting process of the vehicle.

Another type of roller, is made from metal with a press-fit plastic bushing. This type of roller has certain drawbacks. When the vehicle is subjected to the painting process, high temperatures are used. The high temperatures cause the plastic bushing to be stress-relieved and shrink. Once the bushing has shrunk, the press-fit interference may be lost such that the bushing no longer rotates with the metal roller. This can cause the roller to seize on the roller mounting pin and create loud noises. Typically lubrication is used to alleviate the undesirable noises, however this introduces the problems inherent with lubrication as outlined above.

Rollers are subjected to relatively high wear and tear. Therefore, rollers made from plastic alone are not acceptable because plastic rollers will wear out quickly.

Thus, it would be desirable to provide an improved door check device with a roller that will have a long life, yet be quiet in operation, and not require lubrication.

SUMMARY OF THE INVENTION

One embodiment of the present invention provides a door check device for installation between a motor vehicle body and a motor vehicle door that swings in opposing opening and closing directions relative to the vehicle body. The door check includes a first mounting bracket, a second mounting bracket having at least one roller mounting pin, a link member, and a roller. The first mounting bracket is constructed and arranged to be mounted on one of a vehicle door and a vehicle body and the second mounting bracket is constructed and arranged to be mounted on the other such that the first and second mounting brackets move relative to one another as the door is swung in the opposing opening and closing directions. The link member is carried by the first mounting bracket. The roller is carried by the second mounting bracket on the roller mounting pin such that the link member is in contact with the roller. The roller includes a metal core having an internal bore in which the roller mounting pin is received and a plastic bushing lining the internal bore of the metal core. The metal core and the plastic bushing have interlocked or bonded structures that essentially prevent relative rotation between the metal core and the plastic bushing.

These and other objects, features, and advantages of this invention will become apparent from the following detailed description when taken in conjunction with the accompanying drawings, which are part of this disclosure and which illustrate, by way of example, the principles of this invention.

BRIEF DESCRIPTION OF THE DRAWINGS

The accompanying drawings facilitate an understanding of the various embodiments of the present invention. In the drawings.

DETAILED DESCRIPTION OF THE INVENTION

Figure 1:
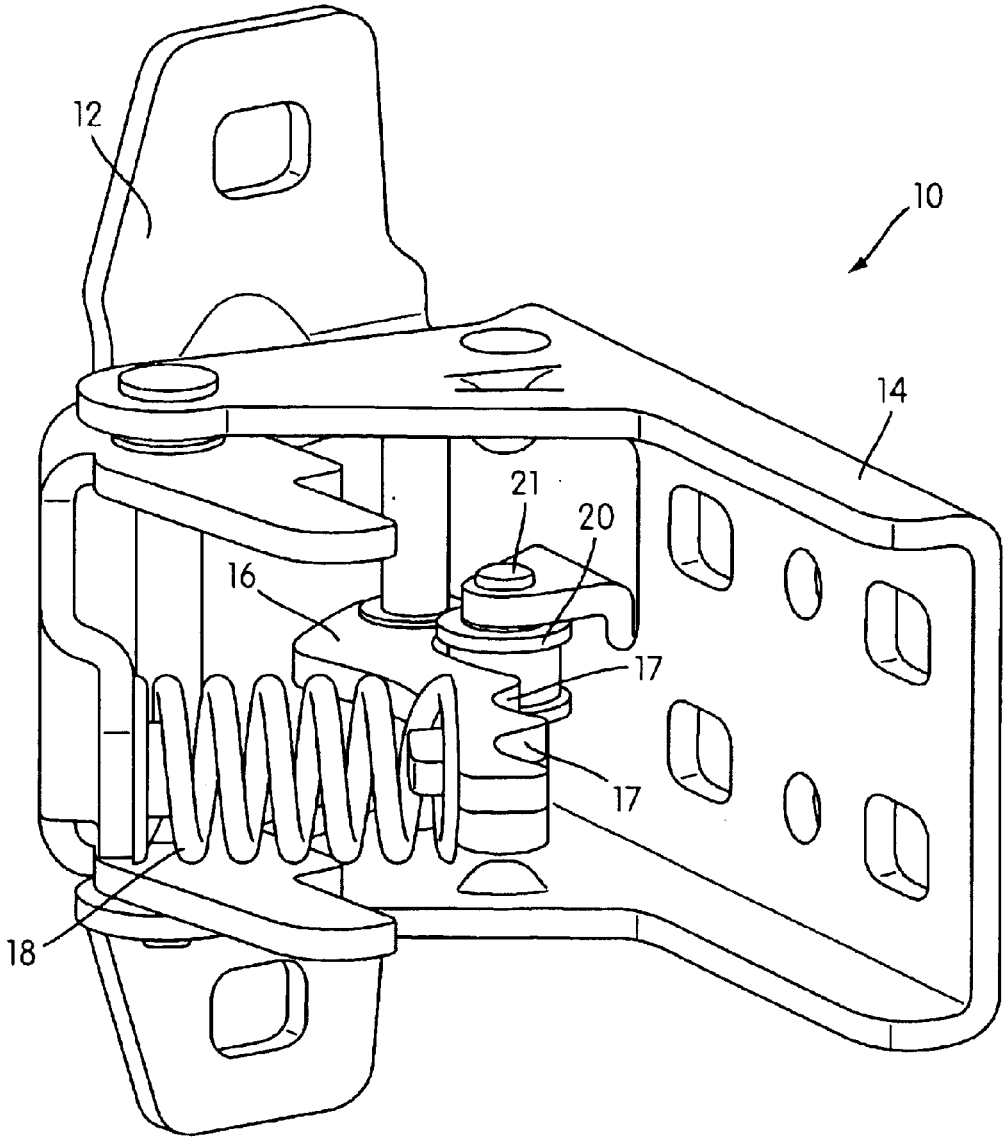
FIG. 1 is a perspective view of a door check device with a portion of the housing removed for clarity purposes, the device illustrated also functioning as a door hinge.

FIG. 1 illustrates a door check device 10 for installation between a motor vehicle body and a motor vehicle door that swings in opposing opening and closing directions relative to the vehicle body. The construction of the motor vehicle and the door thereof are not considered to be part of the present invention and thus will not be detailed herein. Instead, the present invention is concerned with the door check device 10.

The door check device 10 includes a first mounting bracket 12, a second mounting bracket 14, a link member 16, a roller 20, a roller mounting pin 21, and a biasing member 18. The first mounting bracket 12 is constructed and arranged to be mounted on one of a vehicle door and a vehicle body. The second mounting bracket 14 is constructed and arranged to be mounted on the other of the vehicle door and the vehicle body such that the first 12 and second 14 mounting brackets move relative to one another as the door is swung in the opposing opening and closing directions thereof relative to the vehicle body. In the illustrated embodiment, the first mounting bracket 12 is constructed to be mounted to the vehicle door and the second mounting bracket 14 is constructed to be mounted to the vehicle body. However, in any given embodiment of the present invention the first mounting bracket 12 could be mounted to the vehicle body and the second mounting bracket 14 could be mounted to the vehicle door.

The door check device 10 illustrated in FIG. 1 is an integrated check with the first 12 and second 14 mounting brackets pivotally coupled together for hingedly supporting the vehicle door. Alternatively, the door check device 10 may be constructed such that the first 12 and second 14 mounting brackets are separate from one another and do not provide hinged support. This is referred to as a separate check.

The first 12 and second 14 mounting brackets can be constructed from any suitable material, including but not limited to steel. The brackets 12, 14 may be cast, machined, or formed in any suitable manner. Preferably, the brackets 12, 14 are stamped from steel.

The link member 16 is connected to the first mounting bracket 12. The link member 16 can be made from any suitable material, including but not limited to steel. The link member 16 may be cast, machined, or formed in any suitable manner. Preferably, the link member 16 is stamped from steel.

The roller 20 is rotatably mounted on a roller mounting pin 21 that is attached to the second mounting bracket 14. The roller 20 is in rolling contact with the link member 16 to control relative movement between the first 12 and second 14 mounting brackets, and hence the vehicle door during the opening and closing movements of the vehicle door. Specifically, the link member 16 has a series of detents 17 thereon. The roller 20 is received within these detents 17 to releasably maintain in checked positions. The roller 20 rotates about a rotational axis 22.

The roller mounting pin 21 can be constructed from any suitable material, including but not limited to steel. The roller mounting pin 21 can be attached to the second mounting bracket 14 by conventional arrangement, including but not limited to welding. Alternatively, the roller mounting pin 21 can be integrally formed with the second mounting bracket 14 itself.

The biasing member 18 includes a first end and a second end. The first end is fixedly attached to the first mounting bracket 12. The second end of the biasing member 18 is in contact with the link member 16, such that it provides enough pressure to the link member 16 to keep the link member 16 in contact with the roller 20. In particular, the biasing member 18 keeps the link member 16 in biased contact with the roller 20 so that when the roller 20 is received within any given detent 17, sufficient pressure to overcome the bias must be applied to the door to disengage the roller 20 and the detent 17. This provides the checking action that releasably maintains the door in predetermined positions. Preferably, the biasing member 18 is a spring.

FIGS. 2–6 illustrate different embodiments of the roller 20. The roller 20 includes a metal core 24 that has an internal bore 25, and a molded plastic bushing 26 that lines the internal bore 25 of the metal core 24. The metal core 24 and the plastic bushing 26 have interlocked structures 30 that essentially prevent relative rotation between the metal core 24 and the plastic bushing 26.

In one embodiment, the interlocked structures 30 include at least one tooth 32 on one of the metal core 24 and the molded plastic bushing 26 and at least one slot 34 on the other of the metal core 24 and the molded plastic bushing 26. In other words, the tooth 32 can be part of either the metal core 24 or the molded plastic bushing 26. If the tooth 32 is part of the metal core 24, then the slot 34 is part of the molded plastic bushing 26 and vice-versa. The tooth 32 is disposed within the slot 34 to provide the interlocked structures 30 and essentially prevent the relative rotation between the metal core 24 and the molded plastic bushing 26. Alternatively, the interlocked structures 30 may include a plurality of teeth 32 on the metal core 24 and a plurality of teeth 33 on the plastic bushing 26 such that the pluralities of teeth 32, 33 are intermeshed to essentially prevent the rotation between the metal core 24 and the plastic bushing 26.

Figure 2:
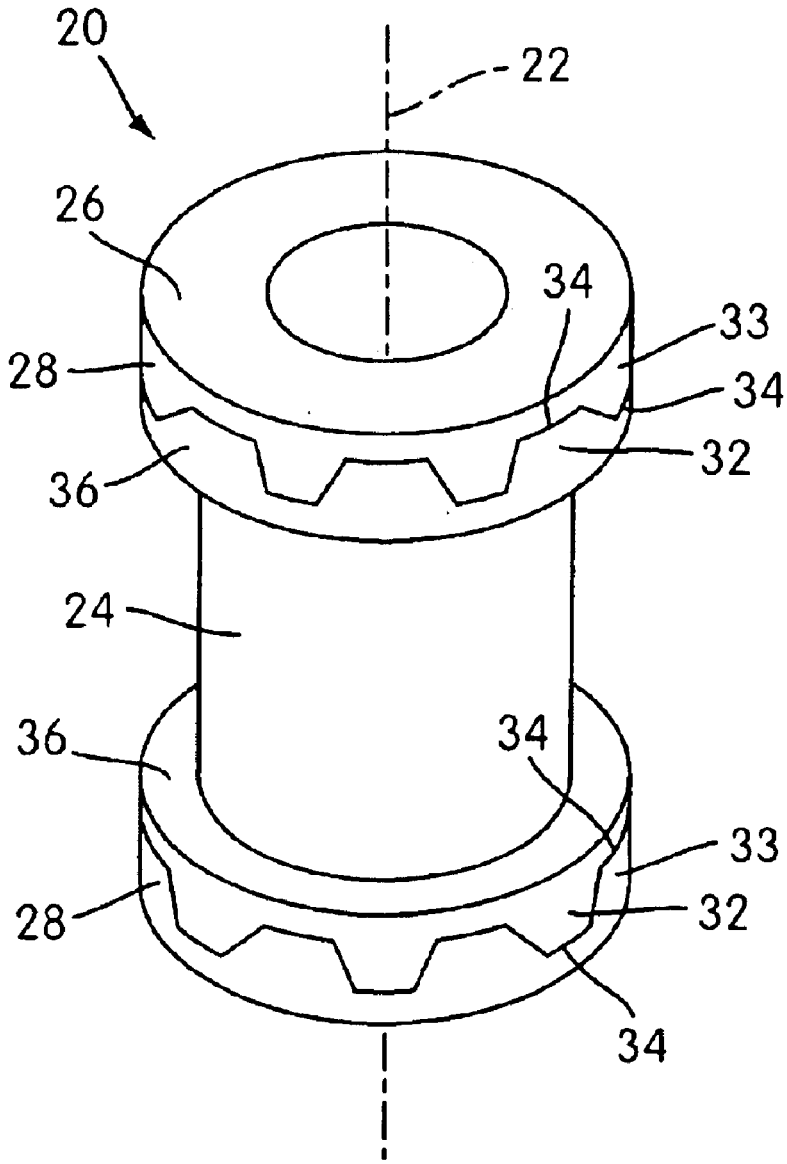
FIG. 2 is a perspective view of one embodiment of a roller for use in the door check device of FIG. 1.

In the preferred embodiment, as illustrated in FIG. 2, the plastic bushing 26 further includes a generally radially extending flange 28 disposed at each end of the metal core 24. The metal core 24 further includes a generally radially extending flange 36 at each end of the metal core 24 that face each flange 28 of the plastic bushing 26. The interlocked structures 30 include at least one tooth 32 on one of each flange 36 of the metal core 24 and each flange 28 of the plastic bushing 26 and at least one slot 34 on the other of the metal core 24 and the plastic bushing 26, such that the tooth 32 is disposed within the slot 34 to essentially prevent the relative rotation between the metal core 24 and the plastic bushing 26. Alternatively, the interlocked structures 30 include a plurality of teeth 32 on each flange 36 of the metal core 24 and a plurality of teeth 33 on each flange 28 of the plastic bushing 26 such that the pluralities of teeth 32, 33 are intermeshed to essentially prevent the relative rotation between the metal core 24 and the plastic bushing 26.

Figure 3:
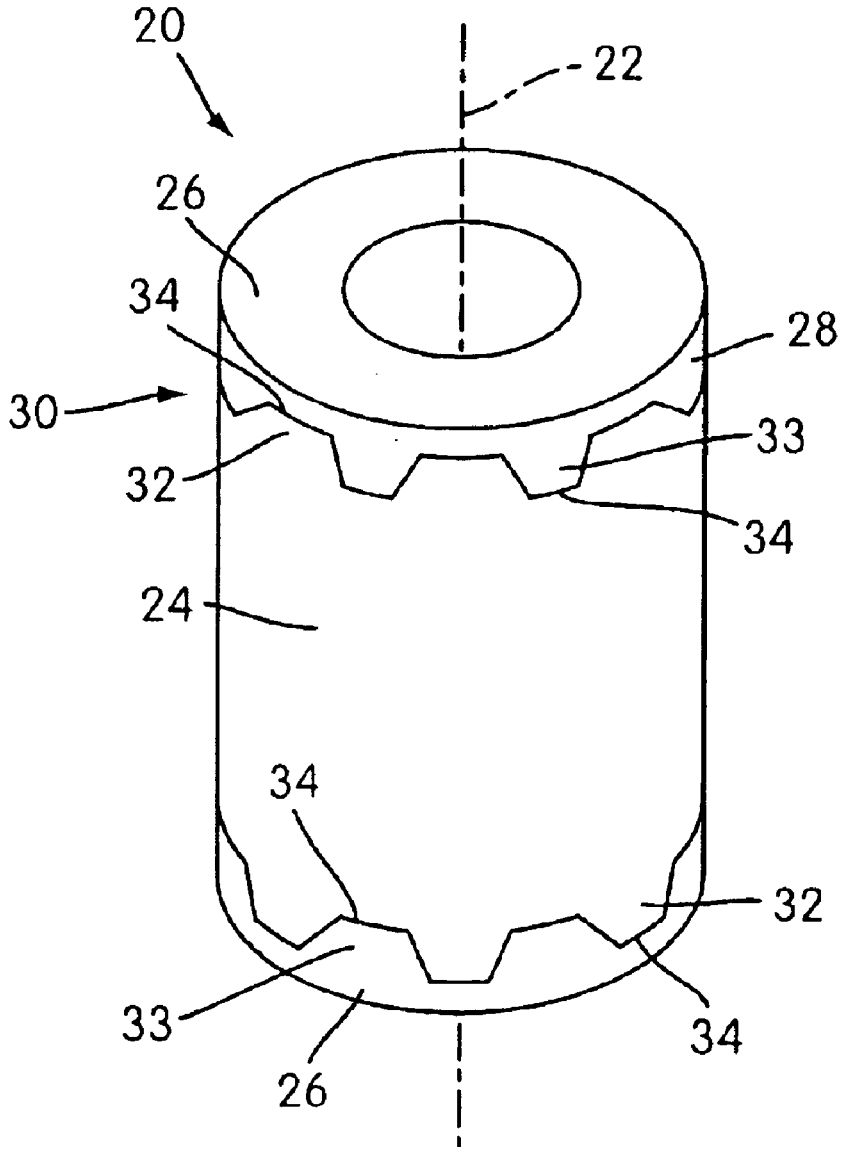
FIG. 3 is a perspective view of another embodiment of the roller.

In another embodiment, as illustrated in FIG. 3, the plastic bushing 26 further includes a generally radially extending flange 28 disposed at each end of the metal core 24. The interlocked structures 30 include at least one tooth 32 on one of each end of the metal core 24 and each flange 28 of the plastic bushing 26 and at least one slot 34 on the other of the metal core 24 and the plastic bushing 26, such that the tooth 32 is disposed within the slot 34 to essentially prevent the relative rotation between the metal core 24 and the plastic bushing 26. Alternatively, the interlocked structures 30 include a plurality of teeth 32 on each end of the metal core 24 and a plurality of teeth 33 on each flange 28 of the plastic bushing 26 such that the pluralities of teeth 32, 33 are intermeshed to essentially prevent the relative rotation between the metal core 24 and the plastic bushing 26.

Figure 4:
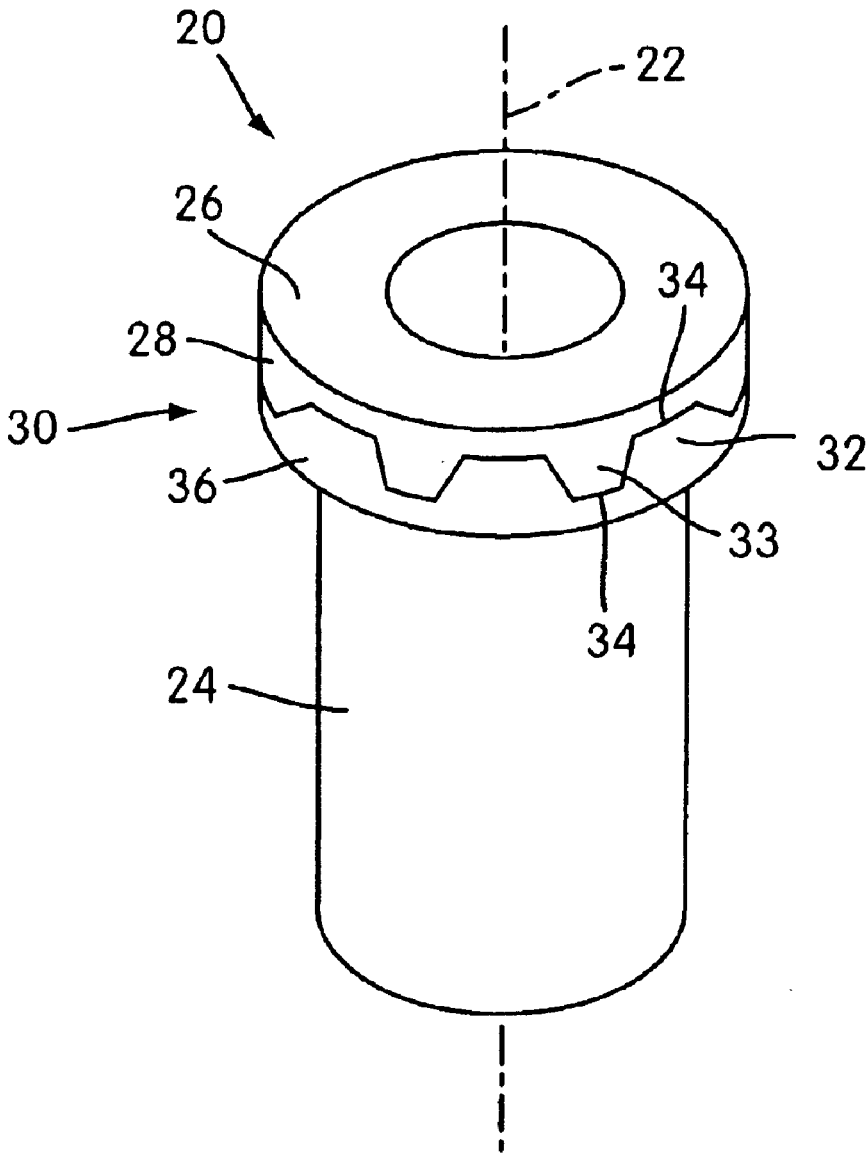
FIG. 4 is a perspective view of another embodiment of the roller.

In another embodiment, as illustrated in FIG. 4, the plastic bushing 26 further includes a generally radially extending flange 28 disposed at an end of the metal core 24. The end of the metal core 24 further includes a generally radially extending flange 36 that faces the flange 28 of the plastic bushing 26. The interlocked structures 30 include at least one tooth 32 on one of the flange 36 of the metal core 24 and the flange 28 of the plastic bushing 26 and at least one slot 34 on the other of the metal core 24 and the plastic bushing 26, such that the tooth 32 is disposed within the slot 34 to essentially prevent the relative rotation between the metal core 24 and the plastic bushing 26. Alternatively, the interlocked structures 30 may include a plurality of teeth 32 on the flange 36 of the metal core 24 and a plurality of teeth 33 on the flange 28 of the plastic bushing 26 such that the pluralities of teeth 32, 33 are intermeshed to essentially prevent the relative rotation between the metal core 24 and the plastic bushing 26.

Figure 5:
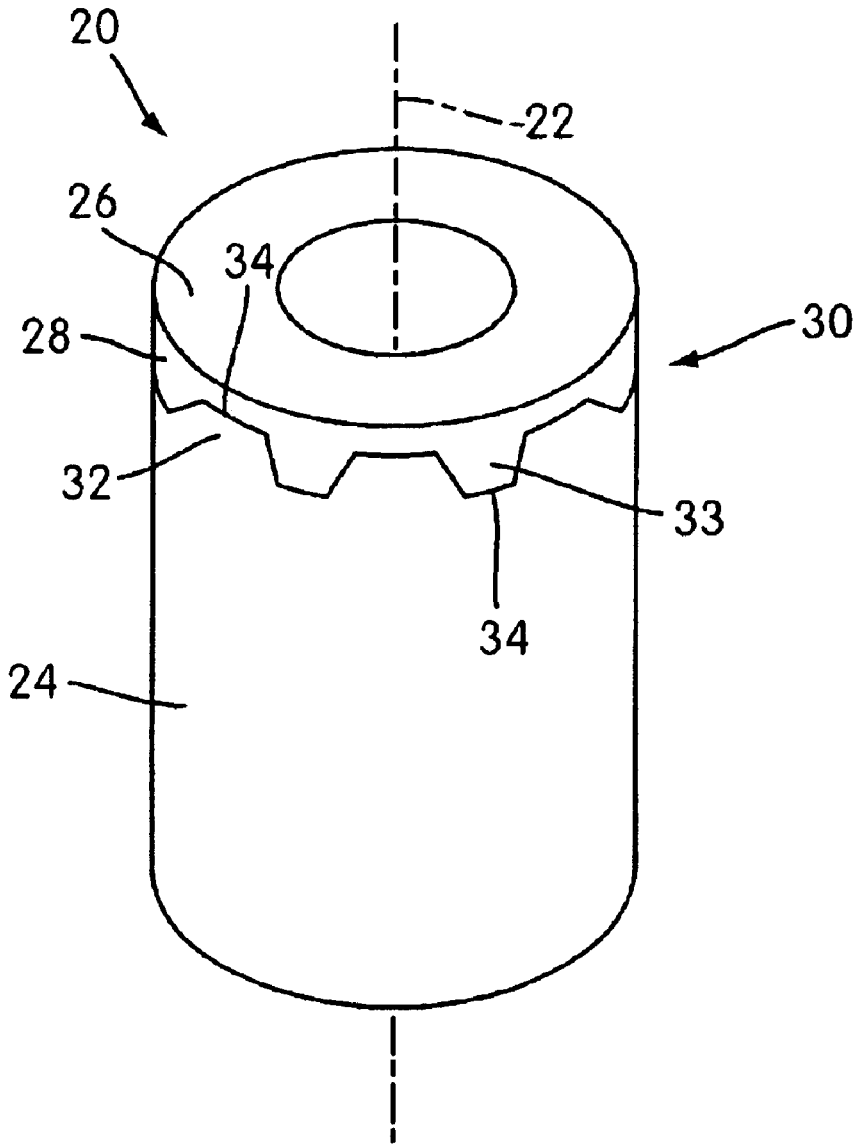
FIG. 5 is a perspective view of another embodiment of the roller.

In another embodiment, as illustrated in FIG. 5, the plastic bushing 26 further includes a generally radially extending flange 28 disposed at an end of the metal core 24. The interlocked structures 30 are provided on the end of the metal core 24 and the flange 28 of the plastic bushing 26. The interlocked structures 30 may include at least one tooth 32 on one of the end of the metal core 24 and the flange 28 of the plastic bushing 26 and at least one slot 34 on the other of the metal core 24 and the plastic bushing 26, such that the tooth 32 is disposed within the slot 34 to essentially prevent the relative rotation between the metal core 24 and the plastic bushing 26. Alternatively, the interlocked structures 30 may include a plurality of teeth 32 on the end of the metal core 24 and a plurality of teeth 33 on the flange 28 of the plastic bushing 26 such that the pluralities of teeth 32, 33 are intermeshed to essentially prevent the relative rotation between the metal core 24 and the plastic bushing 26.

Figure 6:
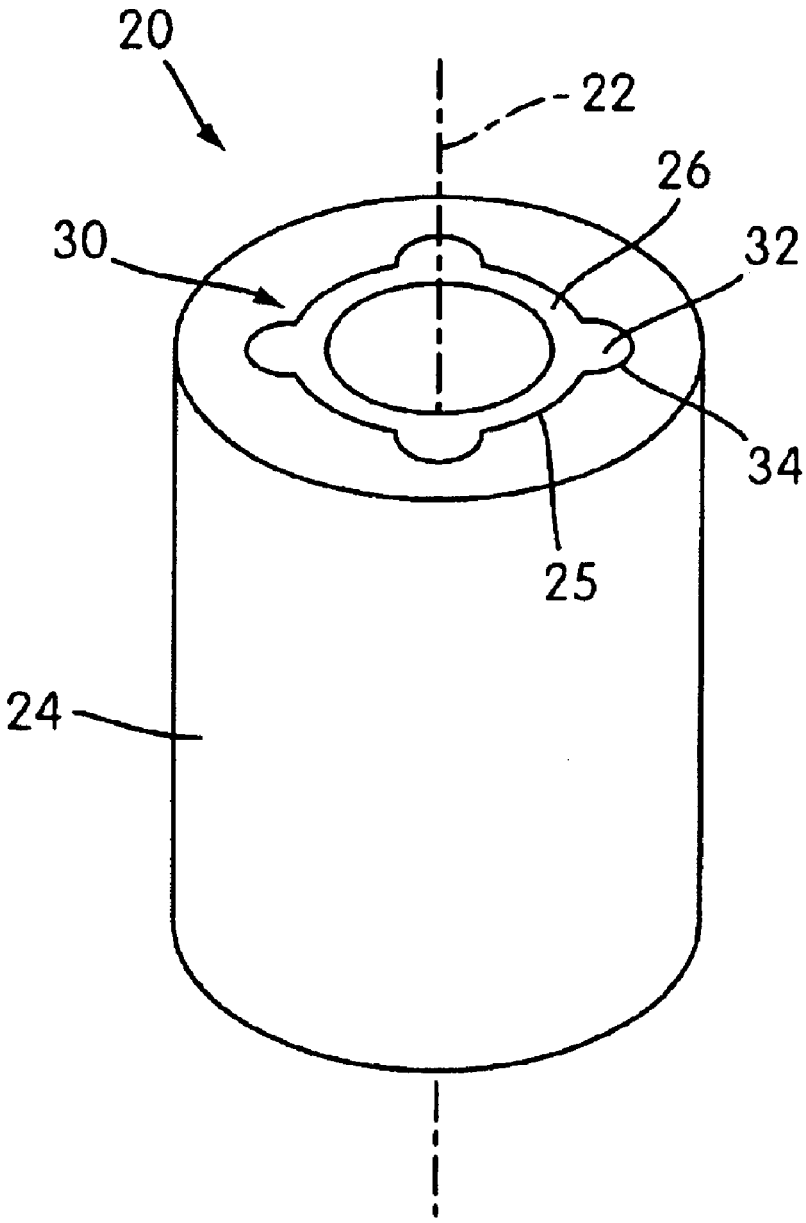
FIG. 6 is a perspective view of another embodiment of the roller.

In yet another embodiment, as illustrated in FIG. 6, the interlocked structures 30 may be disposed parallel to the rotational axis 22 of the roller 20. The interlocked structures 30 may include at least one tooth 32 on one of the internal bore 25 of the metal core 24 and the plastic bushing 26 and at least one slot 34 on the other of the metal core 24 and the plastic bushing 26, such that the tooth 32 is disposed within the slot 34 to essentially prevent the relative rotation between the metal core 24 and the plastic bushing 26. Alternatively, the interlocked structures 30 may include a plurality of teeth 32 on the internal bore 25 of the metal core 24 and a plurality of teeth 33 on the plastic bushing such that the pluralities of teeth 32, 33 are intermeshed to essentially prevent the relative rotation between the metal core 24 and the plastic bushing 26.

In yet another embodiment, not illustrated, the plastic bushing 26 may be bonded to the metal core 24 using an adhesive.

The metal core 24 may be manufactured from any suitable material, including but not limited to steel and composite materials. Preferably, the metal core 24 is steel. Conventional processes may be used to create the metal core 24, including but not limited to machining and casting. Preferably, the metal core 24 is cold headed and machined.

The molded plastic can also contain additives for at least one of strength and lubrication. Preferably, the plastic bushing 26 is molded from a blend of nylon, polytetrafluoroethylene ("PTFE") and glass fibers. The PTFE provides additional lubrication, thereby eliminating the need for grease or other external lubricants, and the glass fibers reinforce the blended nylon and PTFE.

In the preferred embodiment, after the metal core 24 has been created, it is inserted in an injection molding machine. The plastic bushing 26 is then insert molded onto the metal core, thereby creating the roller 20. The metal core 24 acts as a mold for one surface of the plastic bushing 26 while it is in the molding machine. Any teeth 32 or slots 34 that are disposed on the metal core 24 will help form the corresponding slots 34 or teeth 32 on the plastic bushing, respectively, thereby creating the interlocked structures 30. Thus, when the roller 20 is discharged from the molding machine, either the teeth 32 and slots 34, or the plurality of teeth 32 will be intermeshed. Alternatively, a two-piece plastic bushing 26 may be fabricated without the insert molding process by standard molding techniques well known in the art. A two-piece bushing may be press fit or bonded into the internal bore 25 of the metal core 24.

Once the roller 20 is installed in the door check device 10 and the door check device is installed on the motor vehicle, the motor vehicle is subjected to a painting process. This process generally involves high heat. With the interlocked structures 30 of the roller 20 of this invention, any shrinkage of the plastic bushing 26 after the painting process will not affect the performance of the roller 20 in the door check device 10 because the metal core 24 and the plastic bushing 26 will still rotate together. The shrinkage of the plastic material is not enough to withdraw the teeth 32, 33 from their interlocked engagement.

A roller 20 with a plastic bushing 26 that includes flanges 28 at each end has additional advantages. First, the flanges 28 prevent axial movement of the metal core 24. Second, the flanges 28 prevent contact between the metal core 24 and other metal components of the door check device 10, thereby providing quiet operation. Although a non-insert molded two-piece plastic bushing 26 can provide flanges 28 at each end of the metal core 24, the two pieces may become separated over time and one piece may slip out of alignment, thereby potentially exposing the metal core 24 to other metal parts. Thus, it is preferable to create the plastic bushing 26 via the insert molding process.

Figure 7:
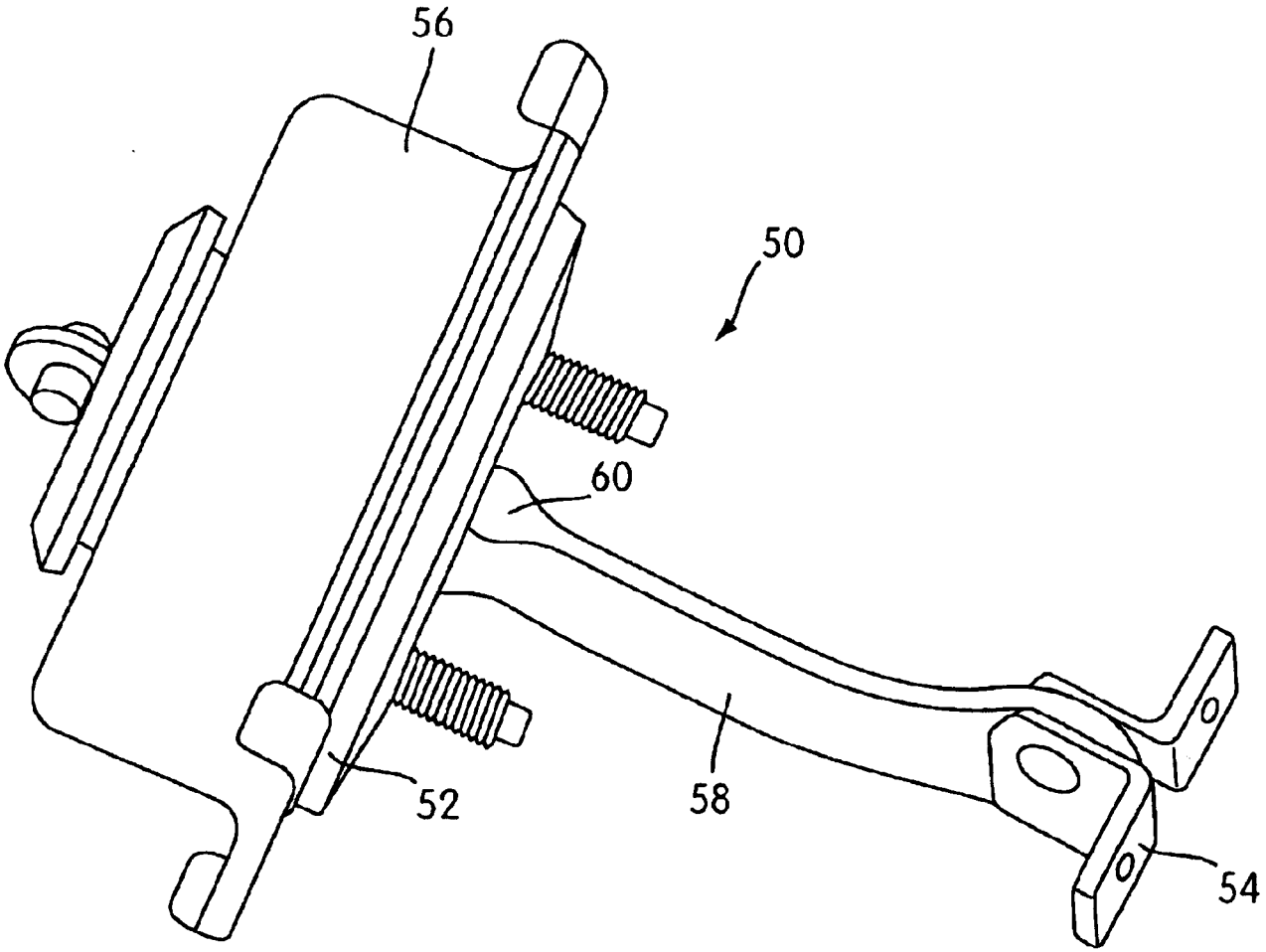
FIG. 7 is a perspective view of a separate door check device.

Although the description heretofore has been specifically directed to integrated door checks, it is envisioned that the roller of this invention may be used in non-integrated, or separate, door checks. In a separate door check, the first and second mounting brackets are separate from one another and do not provide hinged support. For example, FIG. 7 illustrates a separate door check device 50 that includes a first mounting plate 52, a second mounting plate 54, a housing 56, an elongated link member 58 with at least one swell 60. The inner workings disposed within the housing 56 are not detailed here as this illustration is intended to generally describe separate door check devices so that they are distinguished from integrated door check devices. The first mounting plate 52 is mounted on one of a vehicle door and a vehicle body. The second mounting plate 54 is mounted on the other of the vehicle door and vehicle body such that the first 52 and second 54 mounting brackets move relative to one another as the door is swung in the opposing opening and closing directions thereof relative to the vehicle body. The elongated link member 58 passes through the housing 56. At least one roller (not shown) is disposed within the housing 56. As the roller rotates about a rotational axis, the elongated link member 58 is moved relative to the housing 56. The position of the elongated link member 58 can be indexed by the at least one swell 60. It is recognized that the roller 20 of the present invention discussed in detail heretofore can be used in this door check device 50.

While preferred embodiments of the invention have been shown and described, it is evident that variations and modifications are possible that are within the spirit and scope of the preferred embodiments described herein.

What is claimed is:

1. A door check device for installation between a motor vehicle body and a motor vehicle door that swings in opposing opening and closing directions relative to the vehicle body, the door check device comprising:

a first mounting bracket;

a second mounting bracket having at least one roller mounting pin, wherein the first mounting bracket is constructed and arranged to be mounted on one of a vehicle door and a vehicle body and the second mounting bracket is constructed and arranged to be mounted on the other of the vehicle door and the vehicle body such that the first and second mounting brackets move relative to one another as the door is swung in the opposing opening and closing directions thereof relative to the vehicle body;

a link member connected to the first mounting bracket;

a roller rotatably mounted on the roller mounting pin of the second mounting bracket and in rolling contact with the link member to control relative movement between the first and second mounting brackets, and hence the vehicle door during the opening and closing movements of the vehicle door;

the roller comprising a metal core having an internal bore in which the roller mounting pin is received and a molded plastic bushing lining the internal bore of the metal core, the metal core and the plastic bushing comprising interlocked or bonded structures essentially preventing relative rotation between the metal core and the plastic bushing, wherein the plastic bushing further comprises a generally radially extending flange disposed at an end of the metal core.

2. The door check device according to claim 1, wherein the interlocked structures are provided on the end of the metal core and the flange of the plastic bushing.

3. The door check device according to claim 2, wherein the interlocked structures comprise at least one tooth on one of the end of the metal core and the flange of the plastic bushing and at least one slot on the other of the metal core and the molded plastic bushing, the at least one tooth being disposed within the at least one slot to essentially prevent the relative rotation between the metal core and the plastic bushing.

4. The door check device according to claim 3, wherein the interlocked structures comprise a plurality of teeth on the end of the metal core and a plurality of teeth on the flange of the plastic bushing, the pluralities of teeth being intermeshed to essentially prevent the relative rotation between the metal core and the plastic bushing.

5. The door check device according to claim 2, wherein the end of the metal core comprises a generally radially extending flange facing the flange of the plastic bushing.

6. The door check device according to claim 5, wherein the interlocked structures comprise at least one tooth on one of the flange of the metal core and the flange of the plastic bushing and at least one slot on the other of the metal core and the plastic bushing, the at least one tooth being disposed within the at least one slot to essentially prevent the relative rotation between the metal core and the plastic bushing.

7. The door check device according to claim 6, wherein the interlocked structures comprise a plurality of teeth on the flange of the metal core and a plurality of teeth on the flange of the plastic bushing, the pluralities of teeth being intermeshed to essentially prevent the relative rotation between the metal core and the plastic bushing.

8. The door check device according to claim 1, wherein the plastic bushing further comprises a generally radially extending flange disposed at each end of the metal core.

9. The door check device according to claim 8, wherein the interlocked structures comprise at least one tooth on one of each end of the metal core and each flange of the bushing and at least one slot on the other of the metal core and the plastic bushing, the at least one tooth being disposed within the at least one slot to essentially prevent, the relative rotation between the metal core and the plastic bushing.

10. The door check device according to claim 9, wherein the interlocked structures comprise a plurality of teeth on each end of the metal core and a plurality of teeth on each flange of the plastic bushing, the pluralities of teeth being intermeshed to essentially prevent the relative rotation between the metal core and the plastic bushing.

11. The door check device according to claim 8, wherein the metal core further comprises a generally radially extending flange facing each flange of the plastic bushing.

12. The door check device according to claim 11, wherein the interlocked structures comprise at least one tooth on one of each flange of the metal core and each flange of the plastic bushing and at least one slot on the other of the metal core and the plastic bushing, the at least one tooth being disposed within the at least one slot to essentially prevent the relative rotation between the metal core and the plastic bushing.

13. The door check device according to claim 12, wherein the interlocked structures comprise a plurality of teeth on each flange of the metal core and a plurality of teeth on each flange of the plastic bushing, the pluralities of teeth being intermeshed to essentially prevent relative rotation between the metal core and the plastic bushing.

14. A door check device for installation between a motor vehicle body and a motor vehicle door that swings in opposing opening and closing directions relative to the vehicle body, the door check device comprising:

a first mounting bracket;

a second mounting bracket having at least one roller mounting pin, wherein the first mounting bracket is constructed and arranged to be mounted on one of a vehicle door and a vehicle body and the second mounting bracket is constructed and arranged to be mounted on the other of the vehicle door and the vehicle body such that the first and second mounting brackets move relative to one another as the door is swung in the opposing opening and closing directions thereof relative to the vehicle body;

a link member connected to the first mounting bracket;

a roller rotatably mounted on the roller mounting pin of the second mounting bracket and in rolling contact with the link member to control relative movement between the first and second mounting brackets, and hence the vehicle door during the opening and closing movements of the vehicle door;

the roller comprising a metal core having an internal bore in which the roller mounting pin is received and a molded plastic bushing lining the internal bore of the metal core, the metal core and the plastic bushing comprising interlocked or bonded structures essentially preventing relative rotation between the metal core and the plastic bushing, wherein the interlocked structures comprise at least one tooth on one of the metal core and the molded plastic bushing and at least one slot on the other of the metal core and the molded plastic bushing, the at least one tooth being disposed within the at least one slot to essentially prevent the relative rotation between the metal core and the plastic bushing.

15. The door check device according to claim 14, wherein the interlocked structures comprise a plurality of teeth on the metal core and a plurality of teeth on the plastic bushing, the pluralities of teeth being intermeshed to essentially prevent the relative rotation between the metal core and the plastic bushing.

16. The door check device according to claim 14, wherein the metal core comprises steel.

17. The door check device according to claim 14, wherein the plastic of the molded plastic bushing is bonded to the metal core.

18. The door check device according to claim 14, wherein the molded plastic bushing is insert molded onto the metal core.

19. The door check device according to claim 18, wherein the molded plastic bushing comprises nylon.

20. The door check device according to claim 19, wherein the molded plastic bushing further comprises additives for at least one of strength and lubrication.

21. The door check device according to claim 20, wherein the molded plastic further comprises polytetrafluoroethylene (PTFE) and glass fibers.

22. The door check device according to claim 14, wherein the device is an integrated check with the first and second mounting brackets pivotally coupled together for hingedly supporting the vehicle door.

23. The door check device according to claim 14, wherein the first and second mounting brackets are separate from one another.

* * * * *